US010161108B2

(12) United States Patent
Hijikata et al.

(10) Patent No.: US 10,161,108 B2
(45) Date of Patent: Dec. 25, 2018

(54) HYDRAULIC FLUID ENERGY RECOVERY SYSTEM FOR WORK

(71) Applicant: Hitachi Construction Machinery Co., Ltd., Tokyo (JP)

(72) Inventors: Seiji Hijikata, Tsukuba (JP); Kouji Ishikawa, Kasumigaura (JP); Takatoshi Ooki, Kasumigaura (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 341 days.

(21) Appl. No.: 15/023,867

(22) PCT Filed: Jan. 28, 2014

(86) PCT No.: PCT/JP2014/051838
§ 371 (c)(1),
(2) Date: Nov. 22, 2016

(87) PCT Pub. No.: WO2015/114736
PCT Pub. Date: Aug. 6, 2015

(65) Prior Publication Data

US 2017/0073932 A1 Mar. 16, 2017

(51) Int. Cl.
*F15B 21/14* (2006.01)
*E02F 9/22* (2006.01)
(Continued)

(52) U.S. Cl.
CPC ..... *E02F 9/2217* (2013.01); *E02F 9/2075* (2013.01); *E02F 9/2091* (2013.01);
(Continued)

(58) Field of Classification Search
CPC ..... F15B 21/14; F15B 2211/88; E02F 9/2217
See application file for complete search history.

(56) References Cited

U.S. PATENT DOCUMENTS 8,336,305 B2 * 12/2012 Matsuura ..... E02F 9/2207 60/419
8,659,177 B2 * 2/2014 Fujishima ..... E02F 9/2217 290/1 R
(Continued)

FOREIGN PATENT DOCUMENTS

EP 2 657 412 A2 10/2013
JP 2006336842 A 12/2006
(Continued)

OTHER PUBLICATIONS

International Preliminary Report on Patentability (PCT/IB/338 & PCT/IB/373) issued in PCT Application No. PCT/JP2014/051838 dated Aug. 11, 2016, including English translation of Japanese-language Written Opinion (PCT/ISA/237) (six (6) pages).

*Primary Examiner* — F. Daniel Lopez
(74) *Attorney, Agent, or Firm* — Crowell & Moring LLP

(57) ABSTRACT

Provided is a hydraulic fluid energy recovery system for a work machine equipped with a hydraulic pump, a hydraulic actuator for driving the work machine, an operating device for operating the hydraulic actuator, and a regenerating device for recovering a return fluid flowing back from the hydraulic actuator. The hydraulic fluid energy recovery system includes: a fluid line for allowing the return fluid from the hydraulic actuator to flow through the line; a section for branching the fluid line into a plurality of fluid lines; a recovery circuit that serves as one of the branch fluid lines and includes the regenerating device; a discharge circuit that serves as the other of the branch fluid lines and discharges the return fluid to a tank; a flow control device disposed in the discharge circuit so as to be able to control a flow rate of the return fluid; an operation amount detector for detecting the operation amount on the operating device; and a control device configured to acquire the operation amount detected by the operation amount detector, calculate
(Continued)

a target discharge flow rate of the return fluid flowing through the discharge circuit, and calculate a target regeneration flow rate of the return fluid flowing through the recovery circuit, the control device thereby controlling the flow control device according to the target discharge flow rate and also controlling the regenerating device according to the target regeneration flow rate.

16 Claims, 7 Drawing Sheets

(51) Int. Cl.

| | |
|---|---|
| ***E02F 9/20*** | (2006.01) |
| ***F15B 11/08*** | (2006.01) |
| ***F15B 13/04*** | (2006.01) |
| ***F15B 13/044*** | (2006.01) |
| *E02F 3/32* | (2006.01) |

(52) U.S. Cl.

CPC ..... *E02F 9/2285* (2013.01); *E02F 9/2292* (2013.01); *E02F 9/2296* (2013.01); *F15B 11/08* (2013.01); *F15B 13/0401* (2013.01); *F15B 13/044* (2013.01); *F15B 21/14* (2013.01); *E02F 3/32* (2013.01); *F15B 2211/20546* (2013.01); *F15B 2211/41527* (2013.01); *F15B 2211/41581* (2013.01); *F15B 2211/426* (2013.01); *F15B 2211/611* (2013.01); *F15B 2211/6316* (2013.01); *F15B 2211/7053* (2013.01); *F15B 2211/7058* (2013.01); *F15B 2211/88* (2013.01)

(56) References Cited

U.S. PATENT DOCUMENTS

| | | | | |
|---|---|---|---|---|
| 9,476,437 | B2 * | 10/2016 | Egawa ..... | F15B 21/14 |
| 2010/0089049 | A1 | 4/2010 | Matsuura et al. | |
| 2013/0300128 | A1 | 11/2013 | Fujishima et al. | |
| 2014/0052350 | A1 | 2/2014 | Tsuruga et al. | |

FOREIGN PATENT DOCUMENTS

| | | | |
|---|---|---|---|
| JP | 2006336843 | A | 12/2006 |
| JP | 2007107616 | A | 4/2007 |
| JP | 2013061044 | A | 4/2013 |
| JP | 2013068291 | A | 4/2013 |
| JP | 2013200023 | A | 10/2013 |
| WO | WO 2012/160985 | A1 | 5/2012 |
| WO | 2012173149 | A1 | 12/2012 |

* cited by examiner

HYDRAULIC FLUID ENERGY RECOVERY SYSTEM FOR WORK

TECHNICAL FIELD

The present invention relates generally to hydraulic fluid energy recovery systems for work machines, and more particularly, to a hydraulic fluid energy recovery system for work machines equipped with a hydraulic actuator, such as a hybrid-type hydraulic excavator.

BACKGROUND ART

There exist boom energy regenerating devices for work machines including a work unit with a boom and adapted to expand/constrict a boom cylinder by switching a control valve to drive the boom with a view to achieving both an increase in the amount of energy regeneration and the improvement of operability at the same time at a high level without causing an abrupt change in operability. Patent Document 1, for example, discloses such a boom energy regenerating device for work machines, the device including a branching section that branches a hydraulic fluid line for a return fluid from the boom cylinder into two or more lines during downward movement of the boom, a recovery circuit that guides one of the branched fluid lines to a tank via regenerating means, and a flow control circuit that guides the other of the branched fluid lines to the tank via flow control means. The recovery circuit for guiding the fluid to the tank via the regenerating means is disposed outside the control valve.

PRIOR ART DOCUMENT

Patent Document

Patent Document 1: JP-2007-107616-A

SUMMARY OF THE INVENTION

Problems to be Solved by the Invention

In the prior art described above, a flow of the return fluid from the boom cylinder is branched into two fluid lines and one of the fluid lines is connected to the regenerating means at all times, under which state a downward movement rate of the boom can be controlled for improved operational convenience by controlling an outflow rate of the return fluid to the recovery circuit and the flow control circuit. In addition, the amount of energy to be regenerated can be increased by increasing a setting of the outflow rate of the return fluid to the recovery circuit side.

In the above prior art, however, there is a problem in that since flow rate distribution of the return fluid to the recovery circuit side and the flow control circuit side is uniquely performed according to an amount of manipulation of a control lever, more than a necessary amount of the return fluid is drawn out to the flow control circuit side and thus the amount of energy that the energy recovery system can recover is reduced.

The present invention has been made on the basis of the above, and an object of the invention is to provide a hydraulic fluid energy recovery system for work machines, adapted to ensure high operability of a hydraulic actuator and to efficiently recover regenerated energy.

Means for Solving the Problem

A first aspect of the present invention for achieving the above object is a hydraulic fluid energy recovery system for a work machine equipped with a hydraulic pump, a hydraulic actuator for driving the work machine, an operating device for operating the hydraulic actuator, and a regenerating device for recovering a return fluid flowing back from the hydraulic actuator. The hydraulic fluid energy recovery system includes: a fluid line for allowing the return fluid from the hydraulic actuator to flow through the line; a section for branching the fluid line into a plurality of fluid lines; a recovery circuit serving as one of the branch fluid lines, the recovery circuit including the regenerating device; a discharge circuit serving as the other of the branch fluid lines, the discharge circuit being for discharging the return fluid to a tank; a flow control device disposed in the discharge circuit, the flow control device being adapted to control a flow rate of the return fluid; an operation amount detector for detecting the operation amount on the operating device; a discharge flow rate computing unit for acquiring a detection signal from the operation amount detector and calculating a target discharge flow rate of the return fluid flowing through the discharge circuit; a regeneration flow rate computing unit for acquiring the detection signal from the operation amount detector and calculating a target regeneration flow rate of the return fluid flowing through the recovery circuit; and a control device for controlling the flow control device according to the target discharge flow rate and also controlling the regenerating device according to the target regeneration flow rate. The discharge flow rate computing unit calculates the target discharge flow rate that, increases according to the operation amount immediately after a start of the operations on the operating device, and slowly decreases with an elapse of time, and the regeneration flow rate computing unit calculates the target regeneration flow rate set to be smaller than the target discharge flow rate immediately after the start of the operations on the operating device, and slowly increases with an elapse of time according to the operation amount.

A second aspect of the present invention is the work machine hydraulic fluid energy recovery system according to the first aspect of the invention, the system further including a pilot hydraulic pump for supplying a pilot fluid, wherein: the flow control device includes a pressure reducing device to which the pilot fluid is supplied and which outputs a secondary hydraulic fluid reduced in pressure under a command sent from the control device, and a control valve configured to receive an input of the secondary hydraulic fluid that has been output from the pressure reducing device, and to be controlled to an opening degree proportional to the pressure of the secondary hydraulic fluid, and the control device performs control with a lag element added to the control device command with respect to a change in the detection signal from the operation amount detector.

A third aspect of the present invention is the work machine hydraulic fluid energy recovery system according to the second aspect of the invention, wherein the control device is configured to add the lag element by supplying an operation amount signal from the operating device to a computing unit with a low-pass filter function and converting an output of the computing unit as a command addressed to the pressure reducing device.

A fourth aspect of the present invention is the work machine hydraulic fluid energy recovery system according to the second aspect of the invention, wherein the control device is configured to add the lag element by supplying an operation amount signal from the operating device to a computing unit with a change rate limiting function and converting an output of the computing unit as a command addressed to the pressure reducing device.

A fifth aspect of the present invention is the work machine hydraulic fluid energy recovery system according to any one of the first to fourth aspects of the invention, wherein: the regenerating device includes a hydraulic motor driven by the return fluid flowing out from the hydraulic actuator, and a generator-motor mechanically connected to the hydraulic motor; and the control device is configured to control a rotational speed of the generator-motor.

A sixth aspect of the present invention is the work machine hydraulic fluid energy recovery system according to any one of the first to fourth aspects of the invention, wherein: the regenerating device includes a variable displacement hydraulic motor driven by the return fluid flowing out from the hydraulic actuator; and the control device is configured to control a capacity of the variable displacement hydraulic motor.

A seventh aspect of the present invention is the work machine hydraulic fluid energy recovery system according to any one of the first to fourth aspects of the invention, wherein: the regenerating device includes a variable displacement hydraulic motor driven by the return fluid flowing out from the hydraulic actuator, and a generator-motor mechanically connected to the variable displacement hydraulic motor; and the control device is configured to control a capacity of the variable displacement hydraulic motor and a rotational speed of the generator-motor.

Effects of the Invention

In the present invention, immediately after a start of operations, a flow of a total return fluid from the hydraulic actuator is discharged to the tank side, then a flow of the fluid to be branched to the regenerating device side is gradually increased, and a flow rate of the fluid to be discharged to the tank side is slowly reduced. This process ensures high operability of the hydraulic actuator, and at the same time, allows highly efficient recovery of energy.

MODES FOR CARRYING OUT THE INVENTION

Hereunder, embodiments of a hydraulic fluid energy recovery system according to the present invention for work machines will be described with reference to the accompanying drawings.

First Embodiment

Figure 1:
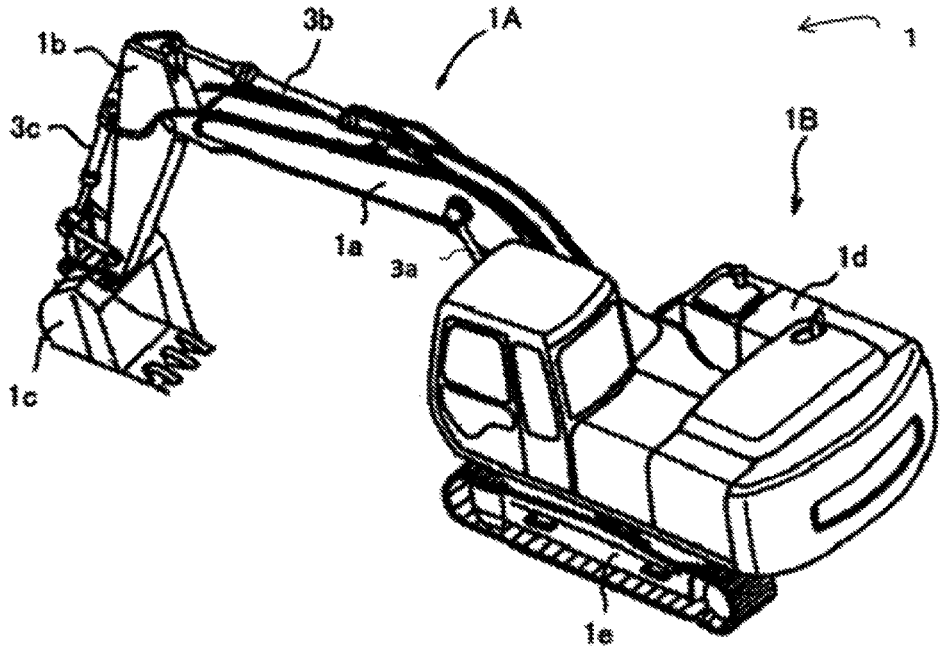
FIG. 1 is a perspective view of a hydraulic excavator incorporating a first embodiment of a hydraulic fluid energy recovery system according to the present invention for work machines.
Figure 2:
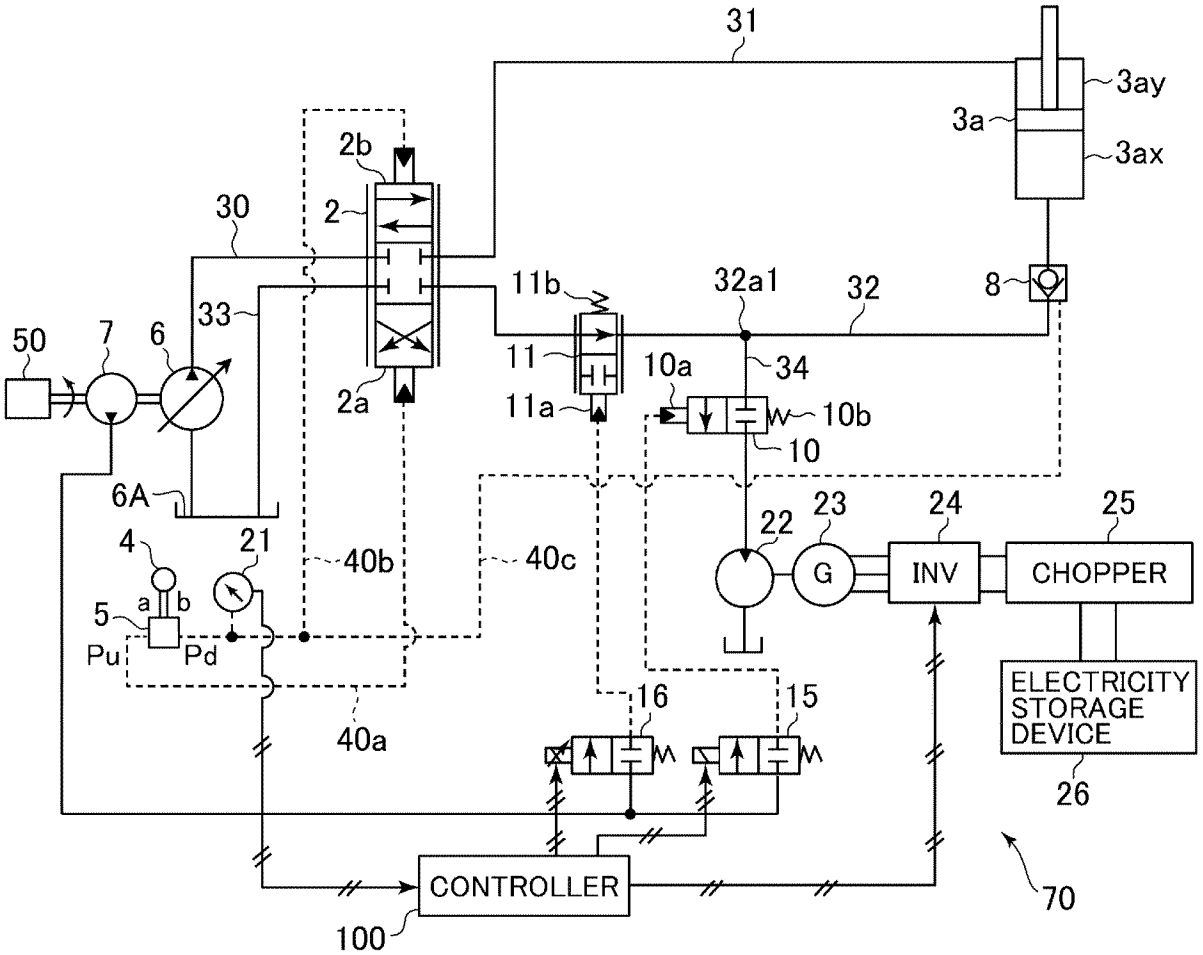
FIG. 2 is a schematic diagram of a control system that shows the first embodiment of the hydraulic fluid energy recovery system according to the present invention for work machines.

FIG. 1 is a perspective view of a hydraulic excavator incorporating a first embodiment of the hydraulic fluid energy recovery system according to the present invention for work machines, and FIG. 2 is a schematic diagram of a control system that shows the first embodiment of the hydraulic fluid energy recovery system according to the present invention for work machines.

The hydraulic excavator 1 in FIG. 1 includes an articulated type of work implement 1A including a boom 1*a*, an arm 1*b*, and a bucket 1*c*, and a vehicle body 1B including an upper swing structure 1*d* and a lower track structure 1*e*. The boom 1*a* is pivotably supported by the upper swing structure 1*d*, and is driven by a hydraulic cylinder 3*a* that operates as a boom cylinder. The upper swing structure 1*d* is swingably disposed on the lower track structure 1*e*.

The arm 1*b* is pivotably supported by the boom 1*a*, and is driven by a hydraulic cylinder 3b that operates as an arm cylinder. The bucket 1*c* is pivotably supported by the arm 1*b*, and is driven by a hydraulic cylinder 3*c* that operates as a bucket cylinder. Actuation of the boom cylinder 3*a*, the arm cylinder 3*b*, and the bucket cylinder 3*c* is controlled by an operating device 4 (see FIG. 2) placed inside a cab of the upper swing structure 1*d* and designed to output hydraulic signals.

Only the control system relating to the boom cylinder 3*a* which operates the boom 1*a* is shown in the embodiment of FIG. 2. The control system includes a control valve 2, the operating device 4, a pilot check valve 8, a recovery switching valve 10, a second control valve 11, a solenoid-operated switching valve 15, a solenoid-operated proportional pressure-reducing valve 16, an inverter 24, a chopper 25, and an electricity storage device 26, the control system further including a controller 100 that operates as a control device.

The control system further includes, as a hydraulic fluid source device, a hydraulic pump 6, a pilot hydraulic pump 7 for supplying a pilot hydraulic fluid, and a tank 6A. The hydraulic pump 6 and the pilot hydraulic pump 7 are driven by an engine 50 coupled to both via a driveshaft.

On a hydraulic fluid line 30 for supplying the hydraulic from the hydraulic pump 6 to the boom cylinder 3*a* is disposed the four-port three-position control valve 2 for controlling a direction and flow rate of the fluid within the hydraulic fluid line. When the pilot hydraulic fluid is supplied to a pilot pressure-receiving port 2*a* or 2*b* of the control valve 2, this control valve switches a position of a spool, supplies the hydraulic fluid from the hydraulic pump 6 to the boom cylinder 3*a*, and thus drives the boom 1*a*.

The control valve 2 to which the hydraulic fluid from the hydraulic pump 6 is supplied has an inlet port connected to the hydraulic pump 6 via the hydraulic fluid line 30. The control valve 2 also has an outlet port connected to the tank 6A via a return fluid line 33.

A rod-side fluid chamber line 31 is connected at one end thereof to one connection port of the control valve 2, and the rod-side fluid chamber line 31 is connected at the other end thereof to a rod-side fluid chamber 3*ay* of the boom cylinder 3*a*. A bottom-side fluid chamber line 32 is connected at one end thereof to the other connection port of the control valve 2, and the bottom-side fluid chamber line 32 is connected at the other end thereof to a bottom-side fluid chamber 3*ax* of the boom cylinder 3*a*.

The second control valve 11, which is a two-port two-position control valve that controls the flow rate of the hydraulic fluid within the fluid line, a recovery branch 32*a*1, and the pilot check valve 8 are arranged in order from the second control valve 2 side, on the bottom-side fluid chamber line 32. A recovery line 34 is connected to the recovery branch 32*a*1.

The second control valve 11 includes a spring 11*b* at one end thereof and a pilot pressure-receiving port 11*a* at the other end. The second control valve 11 has a spool moved according to a pressure of the pilot hydraulic fluid that is input to the pilot pressure-receiving port 11*a*, and an area of an opening through which the fluid passes is therefore controlled. This in turn allows control of an amount of the fluid flowing from the bottom-side fluid chamber 3*ax* of the boom cylinder 3*a* into the control valve 2. The pilot hydraulic fluid is supplied from the pilot hydraulic pump 7 to the pilot pressure-receiving port 11*a* via the solenoid-operated proportional pressure-reducing valve 16 described later herein.

The control valve 2 also includes a spool, whose position is switched by manipulation of a control lever (or the like) of the operating device 4. The operating device 4 includes a pilot valve 5, which, after receiving a primary pilot fluid supplied from the pilot hydraulic pump 7 via a primary pilot fluid line not shown, generates a secondary pilot fluid of a pilot pressure Pu according to an amount of a tilting operation (boom-raising operation) of the control lever or the like in a direction "a" shown in FIG. 2. The secondary pilot fluid is supplied to the pilot pressure-receiving port 2*a* of the control valve 2 via a secondary pilot fluid line 40*a*, and the control valve 2 is switched/controlled according to the pilot pressure Pu.

Similarly, the pilot valve 5 generates a secondary pilot fluid of a pilot pressure Pd according to an amount of a tilting operation (boom-lowering operation) of the control lever or the like in a direction "b" shown in FIG. 2. This secondary pilot fluid is supplied to the pilot pressure-receiving port 2*b* of the control valve 2 via a secondary pilot fluid line 40*b*, and the control valve 2 is switched/controlled according to the pilot pressure Pd.

The spool of the control valve 2, therefore, moves according to the pilot pressure Pu or Pd that is input to either of the two pilot pressure-receiving ports 2*a* and 2*b*, and switches the direction and flow rate of the fluid supplied from the hydraulic pump 6 to the boom cylinder 3*a*.

The secondary pilot fluid of the pilot pressure Pd is also supplied to the pilot check valve 8 via a secondary pilot fluid line 40*c*. Application of the pilot pressure Pd opens the pilot check valve 8. This causes the fluid in the bottom-side fluid chamber 3*ax* of the boom cylinder 3*a* to be guided into the bottom-side fluid chamber line 32. The pilot check valve 8, which is for preventing a fall of the boom due to an accidental flow of the fluid from the boom cylinder 3*a* into the bottom-side fluid chamber line 32, interrupts the circuit in normal condition, and opens the circuit by the application of the pilot fluid pressure.

A pressure sensor 21 is mounted as operation amount detection means on the secondary pilot fluid line 40*b*. The pressure sensor 21, which functions as a signal converter to detect the boom-lowering pilot pressure Pd of the pilot valve 5 connected to the operating device 4 and convert the operation amount into an electrical signal corresponding to the pressure, is configured to output the obtained electrical signal to the controller 100.

Next, the hydraulic fluid energy recovery system 70 that is a regenerating device will be described. The hydraulic fluid energy recovery system 70 includes, as shown in FIG. 2, a recovery line 34, a solenoid-operated switching valve 15, a solenoid-operated proportional pressure-reducing valve 16, a hydraulic motor 22, a generator-motor 23, an inverter 24, a chopper 25, an electricity storage device 26, and the controller 100.

The recovery line 34 includes a recovery switching valve 10 and the hydraulic motor 22 placed at a downstream side of the recovery switching valve 10, and introduces the return fluid from the bottom-side fluid chamber 3*ax* of the boom cylinder 3*a* into the tank 6A via the hydraulic motor 22. The hydraulic motor 22 has a rotational shaft mechanically connected to that of the generator-motor 23. Rotation of the hydraulic motor 22 using the return fluid introduced into the recovery line 34 during the lowering of the boom causes the generator-motor 23 to start rotating and generate electricity. This electrical energy is stored into the electricity storage device 26 via the inverter 24 and the chopper 25 having an electrical boost function.

The recovery switching valve 10 includes a spring 10*b* at one end thereof and a pilot pressure-receiving port 10*a* at the other end thereof, and depending on whether the pilot fluid is supplied to the pilot pressure-receiving port 10*a*, the recovery switching valve 10 switches the position of the spool, thus controlling communication/interruption of the return fluid inflow line from the bottom-side fluid chamber 3*ax* of the boom cylinder 3*a* to the hydraulic motor 22. The pilot fluid is supplied from a pilot hydraulic pump 7 to the pilot pressure-receiving port 10*a* via the solenoid-operated switching valve 15 described in detail later herein.

In addition, the inverter 24 controls speeds at which the hydraulic motor 22 and the generator-motor 23 rotate during the lowering of the boom. This speed control of the hydraulic motor 22 by the inverter 24 allows flow control of the fluid passed through the hydraulic motor 22, and hence, flow control of the return fluid flowing from the bottom-side fluid chamber 3*ax* into the recovery line 34. In other words, the inverter 24 in the present embodiment functions as a flow controller to control the flow rate of the return fluid within the recovery line 34.

The hydraulic fluid that is output from the pilot hydraulic pump 7 is input to an input port of the solenoid-operated switching valve 15 in the present embodiment. Meanwhile, a command signal that is output from the controller 100 is input to an operating port of the solenoid-operated switching valve 15. Supply/interruption of the pilot hydraulic fluid from the pilot hydraulic pump 7 to a pilot operating port 10*a* of the recovery switching valve 10 is controlled according to the command signal.

The hydraulic fluid that is output from the pilot hydraulic pump 7 is input to an input port of the solenoid-operated proportional pressure-reducing valve 16 in the present embodiment. Meanwhile, a command signal that is output from the controller 100 is input to an operating port of the solenoid-operated proportional pressure-reducing valve 16. The spool position of the solenoid-operated proportional pressure-reducing valve 16 is controlled according to this command signal, and the pressure of the hydraulic fluid supplied from the pilot hydraulic pump 7 to the pilot pressure-receiving port 11*a* of the second control valve 11 is controlled as appropriate.

The controller 100 receives an input of the boom-lowering pilot pressure Pd of the pilot valve 5 of the operating device 4 from the pressure sensor 21, then performs an arithmetic operation based on the received input value, and outputs the appropriate command signal to the solenoid-operated switching valve 15, the solenoid-operated proportional pressure-reducing valve 16, and the inverter 24.

Next, operation of the hydraulic fluid energy recovery system in the first embodiment of the present invention for work machines will be outlined.

First, when the control lever of the operating device 4 shown in FIG. 2 is operated in the direction "a" to raise the boom and extend a piston rod, the pilot pressure Pu is transmitted from the pilot valve 5 to the pilot pressure-receiving port 2*a* of the control valve 2 and the control valve 2 is switched. Thus the fluid from the hydraulic pump 6 is introduced into the bottom-side fluid chamber line 32 via the second control valve 11 and flows into the bottom-side fluid chamber 3*ax* of the boom cylinder 3*a* via the pilot check valve 8. This inflow of the fluid extends the piston rod of the boom cylinder 3*a*. The return fluid discharged from the rod-side fluid chamber 3*ay* of the boom cylinder 3*a* is then introduced into the tank 6A through the rod-side fluid chamber line 31 and the control valve 2.

Next, the lowering of the boom will be described. When the control lever of the operating device 4 is operated in the direction "b" to lower the boom and retract the piston rod, the pilot pressure Pd to be supplied from the pilot valve 5 is created and then guided as an operating pressure to the pilot check valve 8, such that the pilot check valve 8 is opened. The pilot pressure Pd is also transmitted to the operating port 2*b* of the control valve 2 and thus the control valve 2 is switched.

In addition, the controller 100 outputs a switching command to the solenoid-operated switching valve 15 and a control command to the solenoid-operated proportional pressure-reducing valve 16. The output of these commands switches the recovery switching valve 10 and the second control valve 11, and thus the fluid in the bottom-side fluid chamber 3*ax* of the boom cylinder 3*a* is discharged to the recovery line 34 (the regenerating device side) and to the tank 6A through the second control valve 11 and the control valve 2. This retracts the piston rod of the boom cylinder 3*a*.

The flow rate of the return fluid discharged to the tank 6A at this time (this flow rate will be hereinafter referred to as the discharge flow rate) is controlled according to a resultant opening area of the control valve 2 and the second control valve 11, and the flow rate of the return fluid flowing into the recovery line 34 (the regenerating device side) rotates the hydraulic motor 22 (this flow rate will be hereinafter referred to as the regeneration flow rate). The hydraulic motor 22 generates electricity by rotating the generator-motor 23 directly connected to the hydraulic motor 22. The generated electrical energy is stored into the electricity storage device 26.

Figure 3:
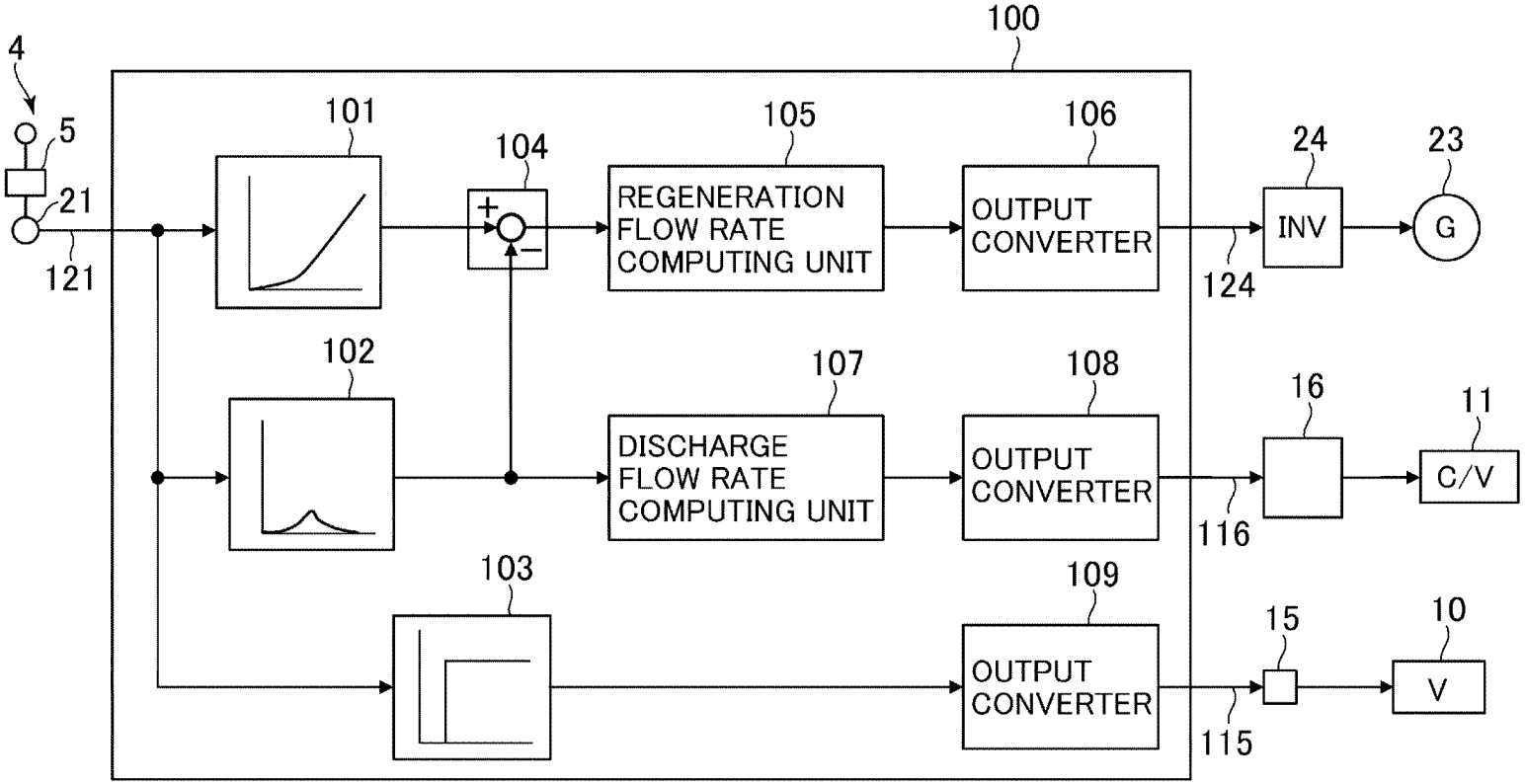
FIG. 3 is a block diagram of a controller constituting the first embodiment of the hydraulic fluid energy recovery system of the present invention for work machines.
Figure 4:
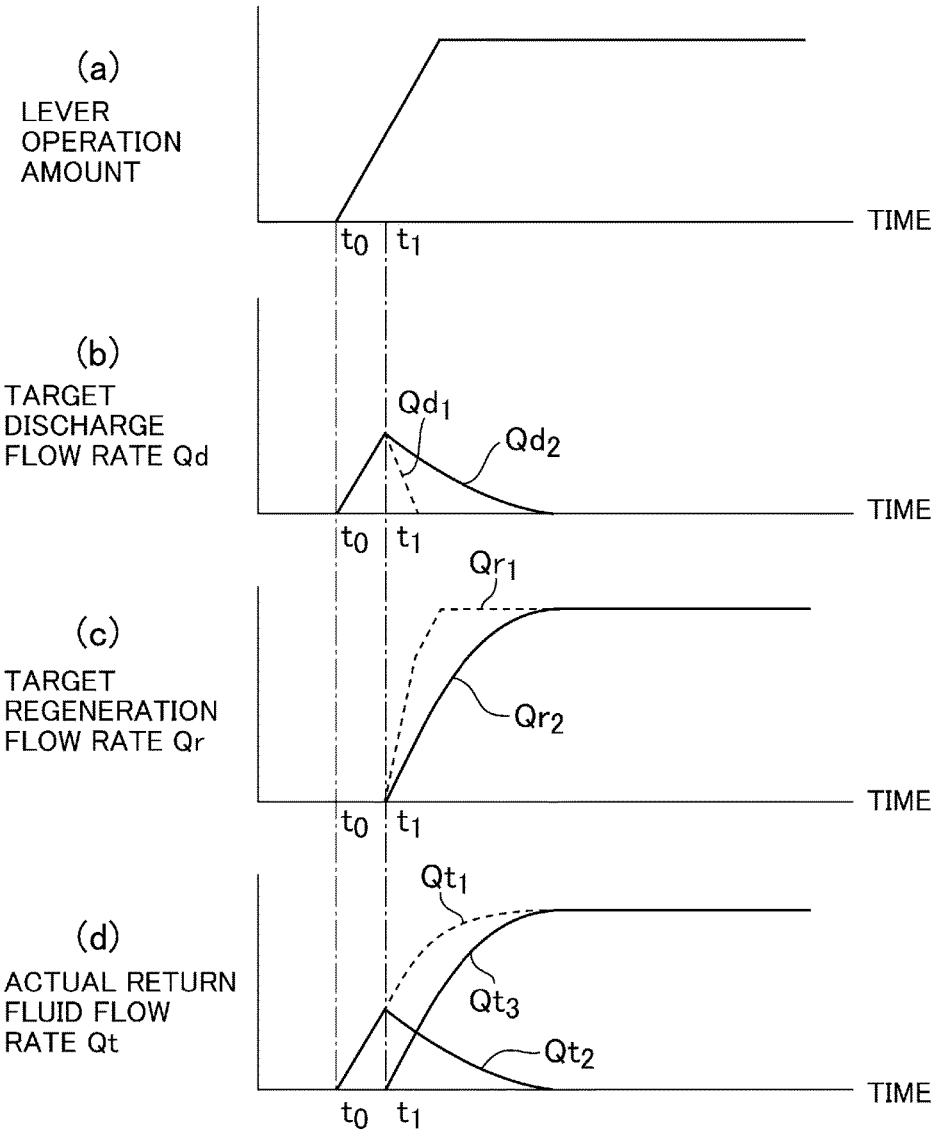
FIG. 4 is a characteristics diagram that illustrates details of control of the controller constituting the first embodiment of the hydraulic fluid energy recovery system of the present invention for work machines.

Next, the control of the controller 100 will be outlined with reference to FIGS. 3 and 4. FIG. 3 is a block diagram of the controller constituting the first embodiment of the hydraulic fluid energy recovery system of the present invention for work machines, and FIG. 4 is a characteristics diagram that illustrates details of the control of the controller constituting the first embodiment of the hydraulic fluid energy recovery system of the present invention for work machines. Referring to FIGS. 3 and 4, the elements that are assigned the same reference numbers as those shown in FIG. 1 or 2 are the same elements and detailed description of these elements will therefore be omitted hereunder.

The controller 100 shown in FIG. 3 includes a first function generator 101, a second function generator 102, a third function generator 103, an addition arithmetic unit 104, a regeneration flow rate computing unit 105, a first output converter 106, a discharge flow rate computing unit 107, a second output converter 108, and a third output converter 109.

The first function generator 101, the second function generator 102, and the third function generator 103 receive a lever manipulation signal 121 as an input signal that indicates the value that the pressure sensor 21 has detected as the boom-lowering pilot pressure Pd of the pilot valve 5 connected to the operating device 4. A target bottom flow rate with respect to the lever manipulation signal 121 is prestored within a table of the first function generator 101 as a target flow rate of the return fluid flowing out from the bottom-side fluid chamber 3*ax* of the boom cylinder 3*a*. A target flow rate of the fluid discharged to the tank 6A is prestored within a table of the second function generator 102 as a target discharge flow rate with respect to the lever manipulation signal 121. A starting point of switching with respect to the lever manipulation signal 121 is prestored within a table of the third function generator 103.

The third function generator 103 outputs, to the third output converter 109, an OFF signal if the lever manipulation signal 121 has a level equal to or less than the starting point of switching, or an ON signal if the lever manipulation signal 121 has a level exceeding the starting point of switching. The third output converter 109 converts the input signal into a control signal of the solenoid-operated switching valve 15 and then outputs the control signal to the solenoid-operated switching valve 15 as a solenoid valve command 115. This activates the solenoid-operated switching valve 15, thereby switching the recovery switching valve 10, and causing the fluid within the bottom-side fluid chamber 3*ax* of the boom cylinder 3*a* to flow into the recovery line 34 (the regenerating device side).

The first function generator 101 outputs the calculated target bottom flow rate to one input end of the addition arithmetic unit 104. The second function generator 102 outputs the calculated target bottom flow rate to one input end of the addition arithmetic unit 104 and the discharge flow rate computing unit 107.

The addition arithmetic unit 104 calculates a target regeneration flow rate that indicates a deviation between the target bottom flow rate and target discharge flow rate that have been input, and then outputs the calculated flow rate to the regeneration flow rate computing unit 105.

The regeneration flow rate computing unit 105 calculates, for example, a first order lag signal as a signal with an added lag element relative to a signal of the target regeneration flow rate which has been input, and then outputs the calculated signal to the first output converter 106. This lag signal can be provided with, for example, a low-pass filter circuit or a rate limiter circuit.

The discharge flow rate computing unit 107 calculates, for example, a first order lag signal as a signal with an added lag element relative to the signal of the target discharge flow rate which has been input, and then outputs the calculated signal to the second output converter 108. This lag signal can be provided with, for example, a low-pass filter circuit or a rate limiter circuit.

The first output converter 106 converts the input target regeneration flow rate into a target generator-motor speed and outputs the target generator-motor speed signal to the inverter 24 as a speed command 124. The output of this command signal controls the regeneration flow rate that is the flow rate of the return fluid within the recovery line 34.

The second output converter 108 converts the input target discharge flow rate into a control signal for the solenoid-operated proportional pressure-reducing valve 16 and outputs the control signal to the solenoid-operated proportional pressure-reducing valve 16 as a solenoid valve command 116. Thus, an opening degree of the second control valve 11 is controlled, and the flow rate of the return fluid to be discharged to the tank 6A is controlled.

Next, a description will be given of a control logic configuration of the controller 100 and the way the control logic configuration ensures high operability by dividing the flow rate of the return fluid from the bottom-side fluid chamber 3*ax* of the boom cylinder 3*a* into the flow rate of the fluid to the regeneration device side (i.e., the regeneration flow rate) and the flow rate of the fluid to the tank side (i.e., the discharge flow rate), and efficiently recovers regenerated energy.

To ensure high operability of a hydraulic actuator, it is important, at an onset of operations that is a transient period when the amount of lever manipulation of the operating device 4 changes, for the regenerating device to provide smooth operation equivalent to that of a hydraulic actuator of a conventional hydraulic excavator. In a steady state where the amount of lever manipulation of the operating device 4 stabilizes at a certain level, smooth operation equivalent to that of the hydraulic actuator of the conventional hydraulic excavator can be obtained since inverter speed control of the regenerating device maintains a constant regeneration flow rate.

In the present embodiment, therefore, immediately after the lever manipulation of the operating device 4 has been started, the flow rate of the return fluid from the bottom-side fluid chamber 3*ax* is controlled with a control valve (for discharge flow control only), as is done in the conventional hydraulic excavator, and this flow control is performed for increases in regeneration flow rate with an elapse of time. In order for the controller 100 to provide the flow control, the function for adding a lag element for an input signal is assigned to the regeneration flow rate computing unit 105 and discharge flow rate computing unit 107 of the controller 100.

Next, functional advantageous effects of the lag element will be described with reference to FIG. 4 that shows behaviors of various device elements. A horizontal axis in FIG. 4 denotes time, and vertical axes (a) to (d) denote, in order from top, the lever manipulation of the operating device 4, the target discharge flow rate Qd, the target regeneration flow rate Qr, and an actual return fluid flow rate Qt. Time t0 denotes the time that the lever manipulation of the operating device 4 was started, and time t1 denotes the time that the hydraulic fluid starts flowing to the regenerating device side.

Referring back to FIG. 3, the control lever manipulation of the operating device 4 is described below. When the control lever of the operating device 4 is operated in a predetermined direction to lower the boom, the pilot pressure Pd is generated in the pilot valve 5, then detected by the pressure sensor 21, and input to the controller 100 as the lever manipulation signal 121. This operation on the control lever is continued at a fixed rate until the lever has reached its maximum operation position from a start of the operation at the time t0.

The lever manipulation signal 121 is input to the second function generator 102. The second function generator 102 then calculates the target discharge flow rate that is the target flow rate of the fluid to be discharged to the tank 6A, and outputs the calculated value to one end of the addition arithmetic unit 104 and the discharge flow rate computing unit 107. The discharge flow rate computing unit 107 calculates the signal incorporating the lag element with respect to the input target discharge flow rate, and outputs the calculated value to the second output converter 108. Referring to target discharge flow rate curve (b) in FIG. 4, reference code Qd1 shown with a broken line denotes output characteristics of the second function generator 102, and reference code Qd2 shown with a solid line denotes output characteristics of the discharge flow rate computing unit 107. The output characteristics of Qd1 and Qd2 overlap in timing between the time t0 and the time t1. As can be seen from these curves, the target discharge flow rate signal that is output from the discharge flow rate computing unit 107 gently decreases in level from the time t1 because the lag element is added.

The first function generator 101 calculates the target bottom flow rate and then outputs the calculated target bottom flow rate to the addition arithmetic unit 104. The addition arithmetic unit 104 calculates the target regeneration flow rate from the target bottom flow rate and the target discharge flow rate, and then outputs the calculated flow rate to the regeneration flow rate computing unit 105. The regeneration flow rate computing unit 105 calculates a signal incorporating the lag element with respect to the input target regeneration flow rate signal, and then outputs the calculated signal to the first output converter 106. Referring to target regeneration flow rate curve (c) in FIG. 4, reference code Qr1 shown with a broken line denotes output characteristics of the addition arithmetic unit 104, and reference code Qr2 shown with a solid line denotes output characteristics of the regeneration flow rate computing unit 105. Since the output signal from the second function generator 102 is subtracted from that of the first function generator 101, the target regeneration flow rate that is output from the addition arithmetic unit 104 becomes zero between the time t0 and the time t1, and starts rising after the time t1. The target regeneration flow rate signal Qr2 from the regeneration flow rate computing unit 105 incorporating the lag element gently increases with respect to the output signal Qr1 of the addition arithmetic unit 104.

Referring to actual return fluid flow rate curve Qt in FIG. 4, reference code Qt1 shown with a broken line denotes an actual total flow rate of the return fluid from the bottom-side fluid chamber 3*ax* of the boom cylinder 3*a*, reference code Qt2 shown with a solid line denotes an actual discharge flow rate, and reference code Qt3 denotes an actual regeneration flow rate. Characteristics of Qt1 and Qt2 overlap in timing between the time t0 and the time t1. As can be seen from these curves, the discharge flow rate Qt2 increases immediately after the lever manipulation signal from the operating device 4 has been input (i.e., between the time t0 and the time t1), and thereafter (i.e., after the time t1), the discharge flow rate Qt2 gradually decreases. In addition, after the time t1, as the discharge flow rate Qt2 decreases, the regeneration flow rate Qt3 gradually increases, which yields the characteristics that a sum of the discharge flow rate Qt2 and the regeneration flow rate Qt3 becomes the total flow rate Qt1 of the return fluid from the bottom-side fluid chamber 3*ax* of the boom cylinder 3*a*.

Accordingly, even if an operator abruptly operates the control lever, the flow of the total return fluid to the tank side (i.e., the discharge flow rate side) increases at a start of movement of the boom cylinder 3*a*, a hydraulic actuator, and after that, the flow of the fluid to the regenerating device side (i.e., the regeneration flow rate side) gradually increases. That is to say, high operability can be obtained. In addition, the flow rate of the fluid whose flow is branched to the tank side (i.e., the discharge flow rate side) is slowly reduced, which prevents an unnecessary discharge of the fluid to the tank. Furthermore, under the steady state, since the return fluid is not drawn out to the tank side, high energy recovery efficiency can be provided.

Next, operation of the control logic of the hydraulic fluid energy recovery system according to the first embodiment of the present invention for work machines will be described with reference to FIGS. 2 and 3.

When the control lever of the operating device 4 is operated in the predetermined direction to lower the boom, the pilot pressure Pd is generated in the pilot valve 5, then detected by the pressure sensor 21, and input to the controller 100 as the lever manipulation signal 121.

The lever manipulation signal 121 is input from the controller 100 to the first function generator 101, the second function generator 102, and the third function generator 103. The third function generator 103 generates an ON signal if the lever manipulation signal 121 has a level exceeding the starting point of switching. The ON signal is then output to the solenoid-operated switching valve 15 via the third output converter 109. Accordingly the hydraulic fluid from the pilot hydraulic pump 7 is input to the pilot operating port 10*a* of the recovery switching valve 10 via the solenoid-operated switching valve 15. Switching to the open side is then performed and the return fluid from the bottom-side fluid chamber 3*ax* of the boom cylinder 3*a* flows into the regenerating device.

The first function generator 101 and the second function generator 102 calculate the target bottom flow rate and the target discharge flow rate, respectively, according to the lever manipulation signal 121. The addition arithmetic unit 104 calculates the target regeneration flow rate from the target bottom flow rate and the target discharge flow rate. The target regeneration flow rate and the target discharge flow rate are input to the regeneration flow rate computing unit 105 and the discharge flow rate computing unit 107, respectively.

The regeneration flow rate computing unit 105 and the discharge flow rate computing unit 107 generate command signals incorporating a lag element, and then output control signals 124 and 116 to the inverter 24 and the solenoid-operated proportional pressure-reducing valve 16, respectively, via the first output converter 106 and the second output converter 108.

Consequently, the rotational speed of the generator-motor 23 is increased progressively, and thus the opening degree of the second control valve 11 is reduced progressively. Immediately after the control lever of the operating device 4 has been operated, the flow of the total return fluid to the tank side (i.e., the discharge flow rate side) increases much and then the flow of the fluid to the regenerating device side (i.e., the regeneration flow rate side) gradually increases. In addition, the flow rate of the fluid whose flow is branched to the tank side (i.e., the discharge flow rate side) is slowly reduced, which prevents an unnecessary discharge of the fluid.

The operation that has been described above allows the provision of the smooth cylinder operation in response to the lever manipulation, and hence allows the efficient recovery of energy as well.

In the hydraulic fluid energy recovery system according to the above-described first embodiment of the present invention for work machines, the total flow of the return fluid from the boom cylinder 3*a* that is a hydraulic actuator is discharged to the tank 6A side immediately after the start of operations, then the flow of the fluid to be branched to the regenerating device 70 is gradually increased, and the discharge flow rate of the fluid in the flow line extending to the tank 6A is slowly reduced. The high operability of the boom cylinder 3*a*, a hydraulic actuator, can therefore be obtained and the highly efficient recovery of energy can be provided.

In addition, in the hydraulic fluid energy recovery system according to the above-described first embodiment of the present invention for work machines, even if the operator abruptly operates the control lever, the flow of the total return fluid to the tank 6A side increases at the start of movement of the boom cylinder 3*a*, and after that, the flow of the fluid to the regenerating device 70 side gradually increases. High operability can be obtained as a result. Furthermore, the flow rate of the fluid whose flow is branched to the tank 6A side is slowly reduced, which prevents an unnecessary discharge of the fluid to the tank 6A. Moreover, under the steady state, since the return fluid is not drawn out to the tank 6A side, high energy recovery efficiency can be provided.

Second Embodiment

Figure 5:
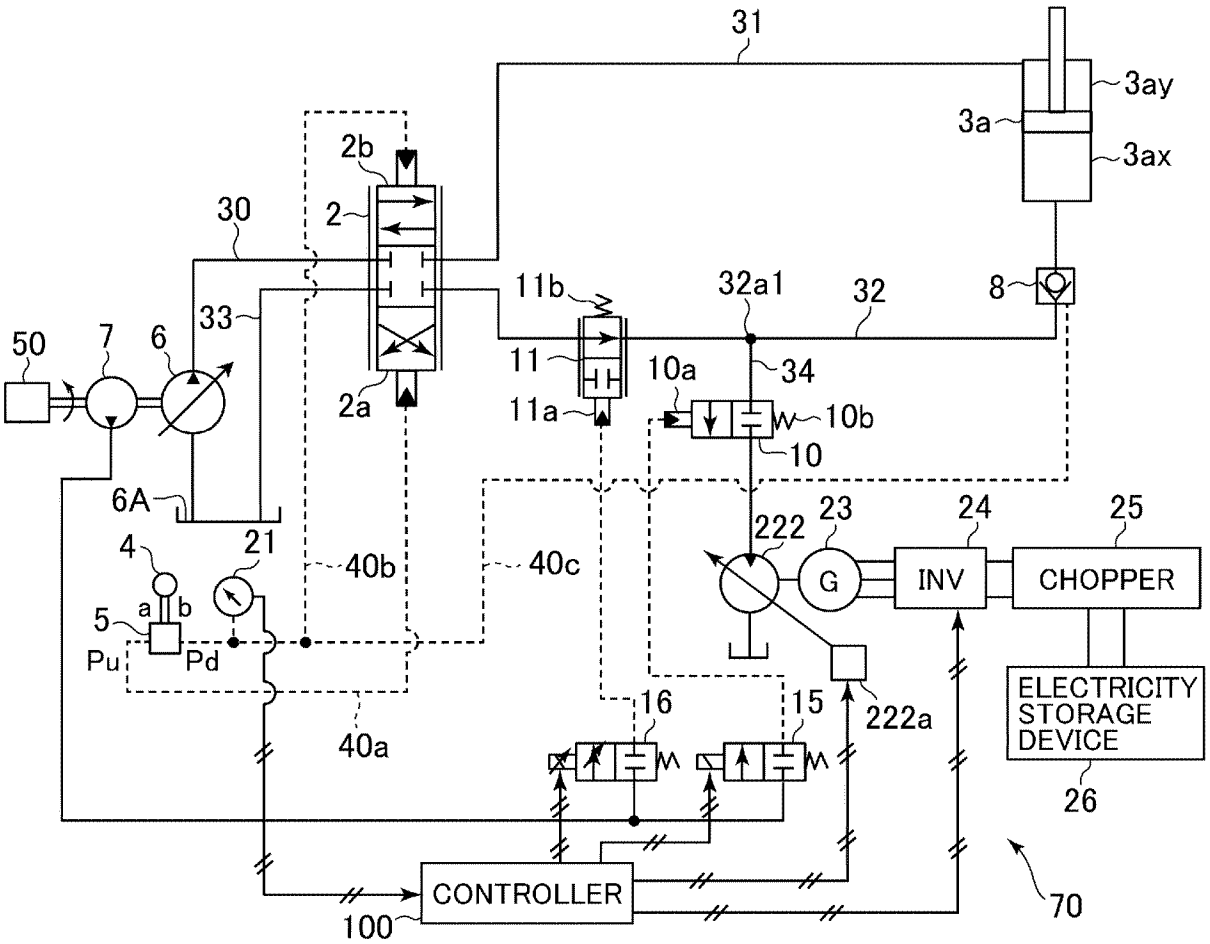
FIG. 5 is a schematic diagram of a control system that shows a hydraulic fluid energy recovery system according to a second embodiment of the present invention for work machines.
Figure 6:
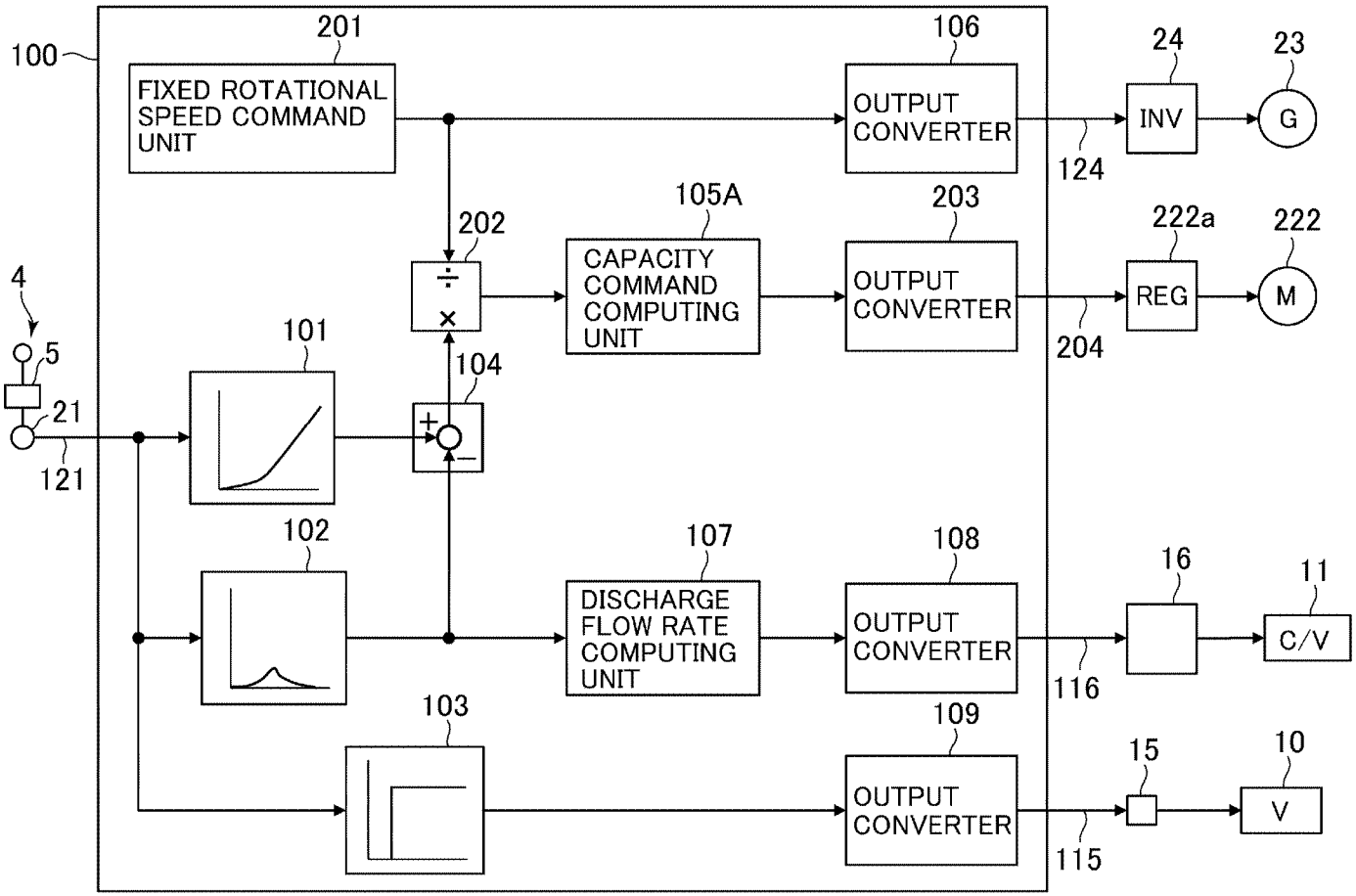
FIG. 6 is a block diagram of a controller constituting a part of the hydraulic fluid energy recovery system according to the second embodiment of the present invention for work machines.

Hereunder, a second embodiment of a hydraulic fluid energy recovery system according to the present invention for work machines will be described with reference to part of the accompanying drawings. FIG. 5 is a schematic diagram of a control system that shows the hydraulic fluid energy recovery system according to the second embodiment of the present invention for work machines, and FIG. 6 is a block diagram of a controller constituting a part of the hydraulic fluid energy recovery system according to the second embodiment of the present invention for work machines. Referring to FIGS. 5 and 6, the elements that are assigned the same reference numbers as those shown in FIGS. 1 to 4 are the same elements and detailed description of these elements will therefore be omitted hereunder.

As shown in FIGS. 5 and 6, the hydraulic fluid energy recovery system according to the second embodiment of the present invention for work machines includes substantially the same hydraulic fluid source, work machine, and other elements, as those of the first embodiment. The system configuration, however, has the following differences. That is to say, in the second embodiment, the hydraulic motor 22 in the first embodiment is replaced by a variable displacement hydraulic motor 222. In addition, a motor regulator 222*a* is disposed in the second embodiment. The motor regulator 222*a* changes a capacity of the variable displacement hydraulic motor 222 in proportion to a command from a controller 100. The controller 100 in the present embodiment differs from that of the first embodiment in that the former includes a fixed rotational speed command unit 201, a division arithmetic unit 202, a fourth output converter 203, and a capacity command computing unit 105A.

The present embodiment controls a regeneration flow rate by rotating the generator-motor 23 at a fixed speed and controlling the capacity of the variable displacement hydraulic motor 222. Constituent elements in FIG. 6 that differ from the elements of the first embodiment will be described hereunder.

In the first embodiment, the output from the addition arithmetic unit 104 is output to the inverter 24 via the regeneration flow rate computing unit 105 and the first output converter 106. In the second embodiment, however, the output from the addition arithmetic unit 104 is input to one end of the division arithmetic unit 202. The fixed rotational speed command unit 201 outputs a generator-motor speed command to the first output converter 106 to always rotate the rotational speed of the generator-motor 23 at a fixed speed. The first output converter 106 then converts the input rotational speed command into a target generator-motor speed and outputs the target generator-motor speed to the inverter 24 as a speed command 124.

The fixed rotational speed command unit 201 also outputs the generator-motor speed command to the other end of the division arithmetic unit 202. The division arithmetic unit 202 receives a target regeneration flow rate command and the generator-motor speed command, both output from the addition arithmetic unit 104, then calculates a target capacity of the variable displacement hydraulic motor 222 by dividing the regeneration flow rate command by the speed command, and outputs the calculated value to the capacity command computing unit 105A.

The capacity command computing unit 105A calculates a signal having an added lag element, such as a first order lag signal, with respect to an input target capacity signal, and then outputs the first order lag signal to the fourth output converter 203. This lag signal can be provided with, for example, a low-pass filter circuit or a rate limiter circuit.

The fourth output converter 203 converts the input target capacity into a tilt angle, for example, and then outputs the tilt angle to the motor regulator 222*a* as a capacity command 204. The output of this command controls the flow rate of the return fluid within the recovery line 34 (i.e., the regeneration flow rate).

The hydraulic fluid energy recovery system according to the above-described second embodiment of the present invention for work machines yields substantially the same advantageous effects as those of the first embodiment.

Third Embodiment

Figure 7:
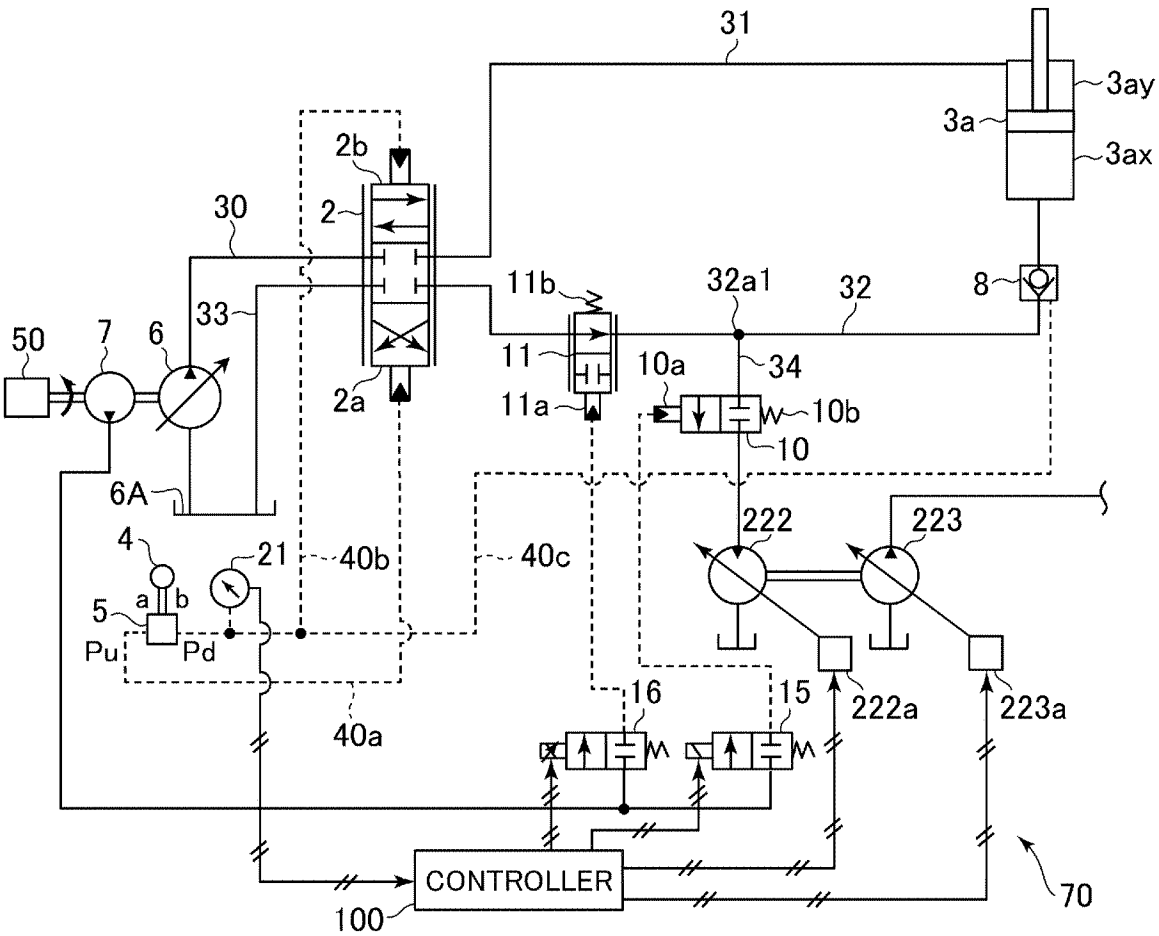
FIG. 7 is a schematic diagram of a control system that shows a third embodiment of a hydraulic fluid energy recovery system according to the present invention for work machines.

Hereunder, a third embodiment of a hydraulic fluid energy recovery system according to the present invention for work machines will be described with reference to part of the accompanying drawings. FIG. 7 is a schematic diagram of a control system that shows the third embodiment of the hydraulic fluid energy recovery system according to the present invention for work machines. Referring to FIG. 7, the elements that are assigned the same reference numbers as those shown in FIGS. 1 to 6 are the same elements and detailed description of these elements will therefore be omitted hereunder.

As shown in FIG. 7, the hydraulic fluid energy recovery system according to the third embodiment of the present invention for work machines includes substantially the same hydraulic fluid source, work machine, and other elements, as those of the first embodiment. The system configuration, however, has the following differences. That is to say, in the third embodiment, the hydraulic motor 22 in the first embodiment is replaced by a variable displacement hydraulic motor 222. In addition, a motor regulator 222*a* is disposed in the third embodiment. Furthermore, a variable displacement hydraulic pump 223 is coupled with the variable displacement hydraulic motor 222. Moreover, a pump regulator 223*a* that renders a capacity of the variable displacement hydraulic pump 223 variable is provided for this pump. A hydraulic fluid from the variable displacement hydraulic pump 223 is supplied to actuators such as an arm cylinder.

The motor regulator 222*a* changes a capacity of the variable displacement hydraulic motor 222 in proportion to a command from a controller 100. The pump regulator 223*a* changes a capacity of the variable displacement hydraulic pump 223 in proportion to a command from the controller 100.

The present embodiment controls a regeneration flow rate by controlling the capacity of the variable displacement hydraulic motor 222.

The hydraulic fluid energy recovery system according to the above-described third embodiment of the present invention for work machines yields substantially the same advantageous effects as those of the first embodiment.

An example in which the variable displacement hydraulic pump 223 is coupled with the variable displacement hydraulic motor 222 has been described in the present embodiment. The description, however, is not intended to limit the scope of application of the present invention. For example, a flywheel may be coupled with the variable displacement hydraulic pump 223 such that the system will store regenerated energy as kinetic energy.

DESCRIPTION OF REFERENCE CHARACTERS

1: Hydraulic excavator
1*a*: Boom
2: Control valve
2*a*: Pilot pressure-receiving port
2*b*: Pilot pressure-receiving port
3*a*: Boom cylinder
3*ax*: Bottom-side fluid chamber
3*ay*: Rod-side fluid chamber
4: Operating device
5: Pilot valve
6: Hydraulic pump
6A: Tank
7: Pilot hydraulic pump
8: Pilot check valve
10: Recovery switching valve
11: Second control valve
15: Solenoid-operated switching valve
16: Solenoid-operated proportional pressure-reducing valve
21: Pressure sensor (Operation amount detector)
22: Hydraulic motor
23: Generator-motor
24: Inverter
25: Chopper
26: Electricity storage device
30: Hydraulic fluid line
31: Rod-side fluid chamber line
32: Bottom-side fluid chamber line
33: Return fluid line
34: Recovery line
40*a*: Secondary pilot fluid line
40*b*: Secondary pilot fluid line
40*c*: Secondary pilot fluid line
50: Engine
100: Controller (Control device)
222: Variable displacement hydraulic motor
222*a*: Motor regulator
223: Variable displacement hydraulic pump
223*a*: Pump regulator

The invention claimed is:

1. A hydraulic fluid energy recovery system for a work machine equipped with a hydraulic pump, a hydraulic actuator for driving the work machine, an operating device for operating the hydraulic actuator, and a regenerating device for recovering a return fluid flowing back from the hydraulic actuator, the hydraulic fluid energy recovery system comprising:

a fluid line for allowing the return fluid from the hydraulic actuator to flow through the line;

a section for branching the fluid line into a plurality of fluid lines;

a recovery circuit serving as one of the branch fluid lines, the recovery circuit including the regenerating device;

a discharge circuit serving as the other of the branch fluid lines, the discharge circuit being for discharging the return fluid to a tank;

a flow control device disposed in the discharge circuit, the flow control device being adapted to control a flow rate of the return fluid;

an operation amount detector for detecting the operation amount on the operating device;

a discharge flow rate computing unit for acquiring a detection signal from the operation amount detector and calculating a target discharge flow rate of the return fluid flowing through the discharge circuit;

a regeneration flow rate computing unit for acquiring the detection signal from the operation amount detector and calculating a target regeneration flow rate of the return fluid flowing through the recovery circuit; and a control device for controlling the flow control device according to the target discharge flow rate and also controlling the regenerating device according to the target regeneration flow rate, wherein:

the discharge flow rate computing unit calculates the target discharge flow rate that, increases according to the operation amount immediately after a start of the operations on the operating device, and slowly decreases with an elapse of time; and the regeneration flow rate computing unit calculates the target regeneration flow rate set to be smaller than the target discharge flow rate immediately after the start of the operations on the operating device, and slowly increases with an elapse of time according to the operation amount.

2. The work machine hydraulic fluid energy recovery system according to claim 1, further comprising a pilot hydraulic pump for supplying a pilot fluid, wherein:

the flow control device includes a pressure reducing device to which the pilot fluid is supplied and which outputs a secondary hydraulic fluid reduced in pressure under a command sent from the control device, and a control valve configured to input of the secondary hydraulic fluid that has been output from the pressure reducing device, the control valve being adjusted to have an opening degree proportional to the pressure of the secondary hydraulic fluid; and the control device performs control with a lag element added to the control device command with respect to a change in the detection signal from the operation amount detector.

3. The work machine hydraulic fluid energy recovery system according to claim 2, wherein:

the control device is configured to add the lag element by supplying an operation amount signal from the operating device to a computing unit with a low-pass filter function and converting an output of the computing unit as a command addressed to the pressure reducing device.

4. The work machine hydraulic fluid energy recovery system according to claim 3, wherein:

the regenerating device includes a hydraulic motor driven by the return fluid flowing out from the hydraulic actuator, and a generator-motor mechanically connected to the hydraulic motor; and the control device is configured to control a rotational speed of the generator-motor.

5. The work machine hydraulic fluid energy recovery system according to claim 3, wherein:

the regenerating device includes a variable displacement hydraulic motor driven by the return fluid flowing out from the hydraulic actuator; and the control device is configured to control a capacity of the variable displacement hydraulic motor.

6. The work machine hydraulic fluid energy recovery system according to claim 3, wherein:

the regenerating device includes a variable displacement hydraulic motor driven by the return fluid flowing out from the hydraulic actuator and a generator-motor mechanically connected to the variable displacement hydraulic motor; and the control device is configured to control a capacity of the variable displacement hydraulic motor and a rotational speed of the generator-motor.

7. The work machine hydraulic fluid energy recovery system according to claim 2, wherein:

the control device is configured to add the lag element by supplying an operation amount signal from the operating device to a computing unit with a change rate limiting function and converting an output of the computing unit as a command addressed to the pressure reducing device.

8. The work machine hydraulic fluid energy recovery system according to claim 7, wherein:

the regenerating device includes a hydraulic motor driven by the return fluid flowing out from the hydraulic actuator, and a generator-motor mechanically connected to the hydraulic motor; and the control device is configured to control a rotational speed of the generator-motor.

9. The work machine hydraulic fluid energy recovery system according to claim 7, wherein:

the regenerating device includes a variable displacement hydraulic motor driven by the return fluid flowing out from the hydraulic actuator; and the control device is configured to control a capacity of the variable displacement hydraulic motor.

10. The work machine hydraulic fluid energy recovery system according to claim 7, wherein:

the regenerating device includes a variable displacement hydraulic motor driven by the return fluid flowing out from the hydraulic actuator and a generator-motor mechanically connected to the variable displacement hydraulic motor; and the control device is configured to control a capacity of the variable displacement hydraulic motor and a rotational speed of the generator-motor.

11. The work machine hydraulic fluid energy recovery system according to claim 2, wherein:

the regenerating device includes a hydraulic motor driven by the return fluid flowing out from the hydraulic actuator, and a generator-motor mechanically connected to the hydraulic motor; and the control device is configured to control a rotational speed of the generator-motor.

12. The work machine hydraulic fluid energy recovery system according to claim 2, wherein:

the regenerating device includes a variable displacement hydraulic motor driven by the return fluid flowing out from the hydraulic actuator; and the control device is configured to control a capacity of the variable displacement hydraulic motor.

13. The work machine hydraulic fluid energy recovery system according to claim 2, wherein:

the regenerating device includes a variable displacement hydraulic motor driven by the return fluid flowing out from the hydraulic actuator and a generator-motor mechanically connected to the variable displacement hydraulic motor; and the control device is configured to control a capacity of the variable displacement hydraulic motor and a rotational speed of the generator-motor.

14. The work machine hydraulic fluid energy recovery system according to claim 1, wherein:

the regenerating device includes a hydraulic motor driven by the return fluid flowing out from the hydraulic actuator, and a generator-motor mechanically connected to the hydraulic motor; and the control device is configured to control a rotational speed of the generator-motor.

15. The work machine hydraulic fluid energy recovery system according to claim 1, wherein:

the regenerating device includes a variable displacement hydraulic motor driven by the return fluid flowing out from the hydraulic actuator; and the control device is configured to control a capacity of the variable displacement hydraulic motor.

16. The work machine hydraulic fluid energy recovery system according to claim 1, wherein:

the regenerating device includes a variable displacement hydraulic motor driven by the return fluid flowing out from the hydraulic actuator and a generator-motor mechanically connected to the variable displacement hydraulic motor; and the control device is configured to control a capacity of the variable displacement hydraulic motor and a rotational speed of the generator-motor.

* * * * *